US007934401B2

(12) United States Patent
Kim et al.

(10) Patent No.: US 7,934,401 B2
(45) Date of Patent: May 3, 2011

(54) STRUCTURE FOR BLOCKING OUTFLOW OF FLUID FOR WASHING MACHINE

(75) Inventors: Gon Kim, Jinhae-Si (KR); Jae Kyum Kim, Kimhae-Si (KR); Chi Wan Hur, Changwon-Si (KR); Yu Beom Kang, Changwon-Si (KR); Sang Man Je, Keoje-Si (KR)

(73) Assignee: LG Electronics Inc., Seoul (KR)

( * ) Notice: Subject to any disclaimer, the term of this patent is extended or adjusted under 35 U.S.C. 154(b) by 552 days.

(21) Appl. No.: 11/048,720

(22) Filed: Feb. 3, 2005

(65) Prior Publication Data

US 2005/0284194 A1 Dec. 29, 2005

(30) Foreign Application Priority Data

Feb. 6, 2004 (KR) ..... 10-2004-0007882
Feb. 6, 2004 (KR) ..... 10-2004-0007883
Feb. 6, 2004 (KR) ..... 10-2004-0007884

(51) Int. Cl.
*D06F 35/00* (2006.01)

(52) U.S. Cl. ..... 68/12.18; 68/12.01; 68/17 R

(58) Field of Classification Search ..... 68/12.01, 68/12.18, 17 R
See application file for complete search history.

(56) References Cited

U.S. PATENT DOCUMENTS

| | | | | |
|---|---|---|---|---|
| 3,934,608 | A * | 1/1976 | Guyton | 137/527.8 |
| 4,987,627 | A * | 1/1991 | Cur et al. | 8/158 |
| 5,299,961 | A * | 4/1994 | Okamoto | 440/89 R |
| 5,386,847 | A * | 2/1995 | Scaramucci | 137/454.2 |
| 2004/0163422 | A1 | 8/2004 | Kim et al. | |

FOREIGN PATENT DOCUMENTS

| | | | |
|---|---|---|---|
| DE | 1410196 | * | 3/1958 |
| DE | 1410196 | | 11/1968 |
| DE | 1610199 | | 3/1972 |
| EP | 0582092 | A1 | 2/1994 |
| IT | EP 0582092 | * | 5/1993 |
| JP | 10-272277 | A | 10/1998 |
| KR | 10-1998-015864 | A | 5/1998 |

* cited by examiner

*Primary Examiner* — Michael Barr
*Assistant Examiner* — Jason Heckert
(74) *Attorney, Agent, or Firm* — Birch, Stewart, Kolasch & Birch, LLP

(57) ABSTRACT

A structure for blocking outflow of a fluid for a washing machine includes a door installed at an outlet of a detergent supply unit such that the door opens the outlet when wash water and detergent are supplied from the detergent supply unit to a washing tub and closes the outlet of the detergent supply unit when foam or steam is discharged from the washing tub to the detergent supply unit, thereby preventing the fluid, such as foam or steam in the washing tub, from flowing to the detergent supply unit through a water supply bellows.

5 Claims, 7 Drawing Sheets

STRUCTURE FOR BLOCKING OUTFLOW OF FLUID FOR WASHING MACHINE

BACKGROUND OF THE INVENTION

1. Field of the Invention

The present invention relates to a structure for blocking outflow of a fluid for a washing machine, and more particularly to a structure for blocking outflow of a fluid for a washing machine to prevent the fluid generated from a washing tub from flowing to a detergent supply unit.

2. Description of the Related Art

Generally, a washing machine is an apparatus for washing laundry contained in a washing tub using action of wash water supplied to the inside of the washing tub and detergent through washing, rinsing, and dehydrating operations.

In the case that detergent is directly poured into a washing tub of a conventional washing machine, it is difficult to supply a proper quantity of the detergent and the laundry may be discolored. Accordingly, a separate detergent supply unit is installed on the upper part of a cabinet of the washing machine.

A water supply bellows for connecting an outlet of the detergent supply unit and a water supply hole of the washing tub is installed, and the detergent and the wash water are introduced into the washing tub through the water supply bellows.

In a washing operation, foam generated from the washing tub of the conventional washing machine flows to the detergent supply unit through the water supply bellows connected to the washing tub, thereby contaminating the detergent supply unit.

Further, in a boiling or drying operation, steam generated from the washing tub is directly discharged from the water supply hole of the washing tub to the outside of the washing machine through the water supply bellows, thereby raising the temperature of the detergent supply unit to cause burns, or being condensed to corrode neighboring elements.

In order to block outflow of the steam, the water supply bellows may be designed such that the bellows is multiply bent or water is always gathered in a U-shaped portion of the water supply bellows. However, when the water gathered in the water supply bellows flows to the washing tub due to the movement of the washing tub, it is impossible to prevent the outflow of the steam.

SUMMARY OF THE INVENTION

Therefore, the present invention has been made in view of the above problems, and it is an object of the present invention to provide a structure for blocking outflow of a fluid for a washing machine, which prevents the fluid from flowing from a washing tub to a detergent supply unit through a water supply bellows.

In accordance with the present invention, the above and other objects can be accomplished by the provision of a structure for blocking outflow of a fluid for a washing machine comprising: a water supply bellows connected to an outlet of a detergent supply unit and a water supply hole of a washing tub; and a door installed at the outlet such that the door can be opened and closed, opened by wash water flowing from the outlet to the water supply bellows, and blocking the flow of the fluid generated from the washing tub towards the detergent supply unit.

Preferably, the detergent supply unit may include a housing provided with the outlet formed at one side thereof; and a detergent container installed in the housing such that the detergent container is slidable for containing detergent.

Further, preferably, the door may include a stationary member connected to the outlet and provided with a hole communicating with the outlet; and a shielding member rotatably connected to one side of the stationary member for shielding the hole of the stationary member.

Preferably, a groove may be formed in the side surface of the stationary member, and a protrusion, which is fitted into the groove by pressure, may be formed on one side of the shielding member.

More preferably, an insertion protrusion may be protruded from the groove of the stationary member towards the shielding member, and an insertion groove, into which the insertion protrusion is inserted, may be formed in the protrusion of the shielding member.

Preferably, a stopper for preventing the shielding member from being separated from the stationary member may be protruded from the stationary member.

Further, preferably, the shielding member may have an oval shape such that a diameter of the shielding member in a transverse direction is a short axis so as not to interfere with the water supply bellows when the shielding member is opened from and closed to the stationary member, and the length of the short axis of the shielding member may be shorter than the diameter of the water supply bellows.

Preferably, an insert-preventing unit for preventing the shielding member from being inserted into the water supply bellows when the door is opened may be installed on the door.

More preferably, the insert-preventing unit may include a plurality of ribs protruded from the shielding member so that the ribs are latched on the water supply bellows when the shielding member is rotated.

Further, preferably, the ribs may be protruded from the shielding member in a longitudinal direction, and be designed such that the heights of the ribs are gradually increased close to a connected portion of the shielding member and the stationary member.

Preferably, a push-preventing unit for preventing the shielding member from being pushed towards the detergent supply unit may be installed on the door.

More preferably, the push-preventing unit may include a rod, both ends of which are connected to both side surfaces of the stationary member such that the rod crosses the hole of the stationary member.

Preferably, an insert-preventing unit for preventing the shielding member from being inserted into the water supply bellows when the door is opened and a push-preventing unit for preventing the shielding member from being pushed towards the detergent supply unit may be installed on the door.

Since the door installed at the outlet of the detergent supply unit opens the outlet when wash water and the detergent are supplied from the detergent supply unit to the washing tub, and closes the outlet of the detergent supply unit when foam or steam are discharged from the washing tub to the detergent supply unit, the structure of the present invention prevents the fluid, such as the foam or steam in the washing tub, from flowing to the detergent supply unit. Further, the structure of the present invention prevents the detergent supply unit from being contaminated by the foam or steam discharged from the washing tub, and neighboring elements from being corroded.

Since the shielding member of the door installed at the outlet of the detergent supply unit has an oval shape, the shielding member does not interfere with the water supply bellows when the shielding member is rotated.

Since a plurality of the ribs are protruded from the shielding member, the ribs first contact the water supply bellows when the shielding member is rotated, thereby preventing the shielding member from being inserted into the water supply bellows.

Since the rod, serving as the push-preventing unit, is installed on the stationary member of the door installed at the outlet of the detergent supply unit such that the rod crosses the hole of the stationary member, the rod latches the shielding member when the shielding member of the door is closed after the supply of the wash water is completed, thereby preventing the shielding member from being pushed towards the detergent supply unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
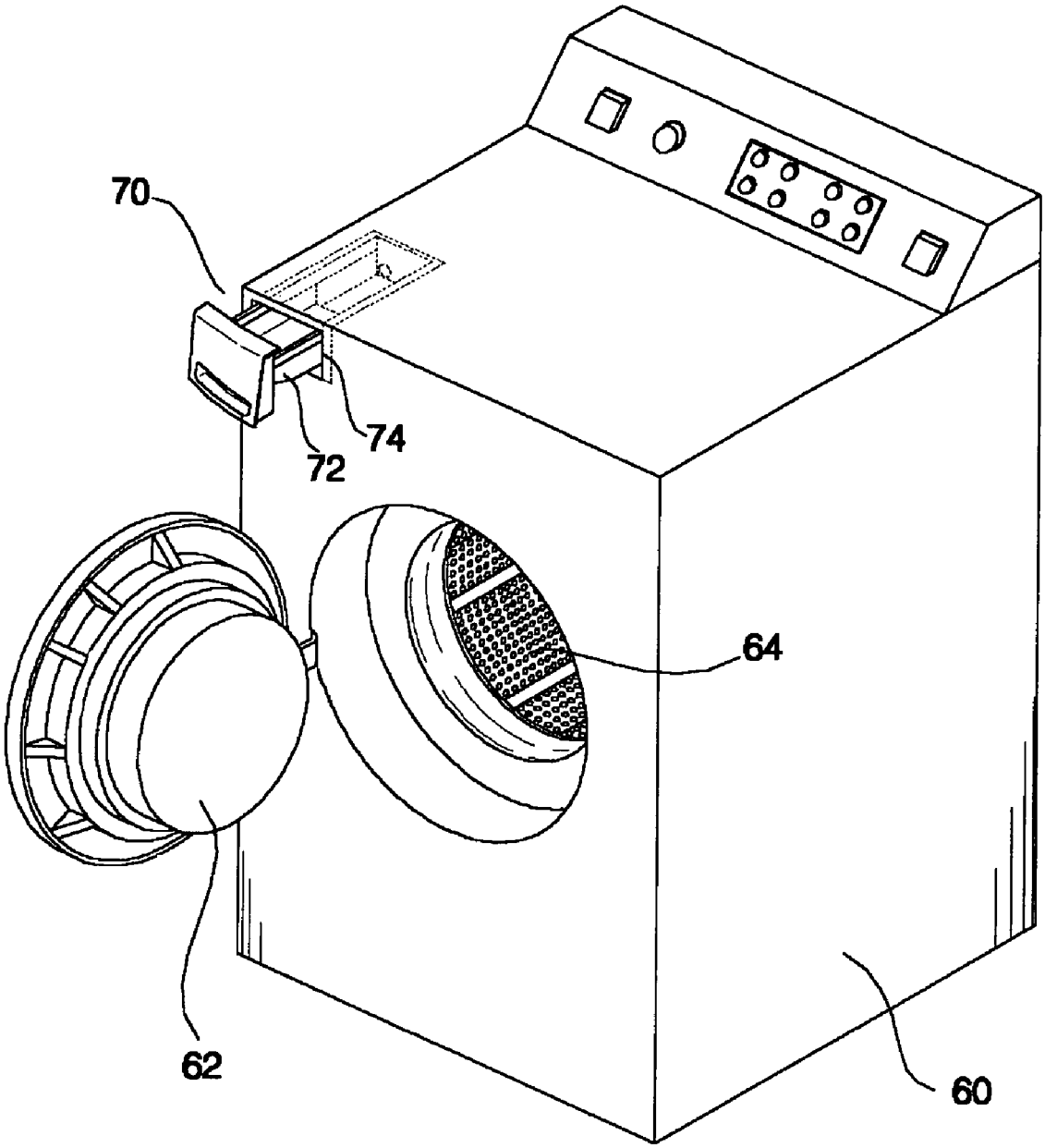
FIG. 1 is a perspective view of a washing machine of the present invention.
Figure 2:
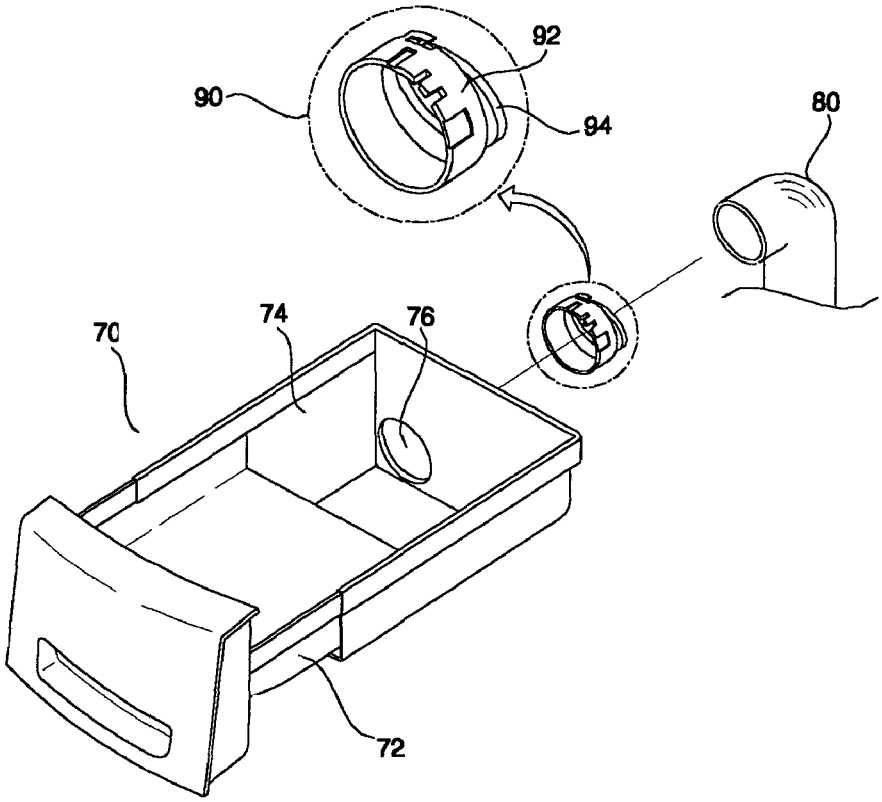
FIG. 2 is an exploded perspective view of a structure for blocking outflow of a fluid for a washing machine in accordance with a first embodiment of the present invention.
Figure 3:
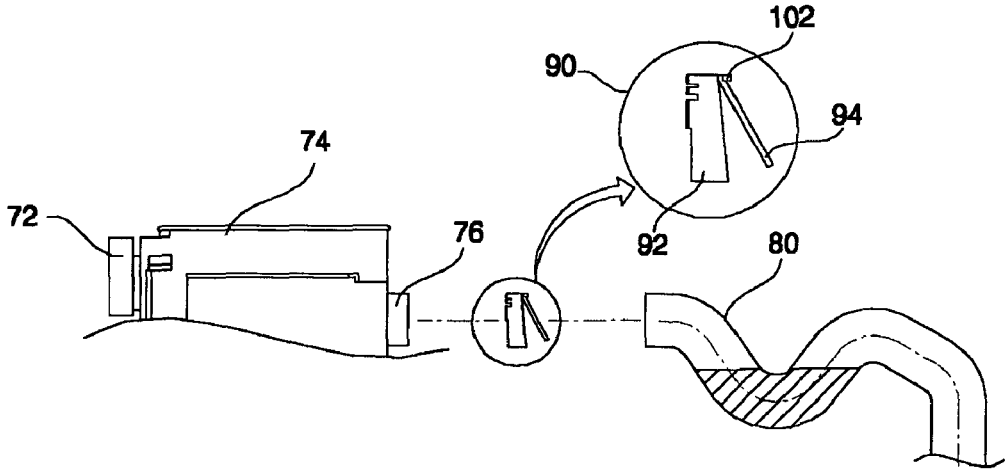
FIG. 3 is a longitudinal sectional view of the structure in accordance with the first embodiment of the present invention.
Figure 4:
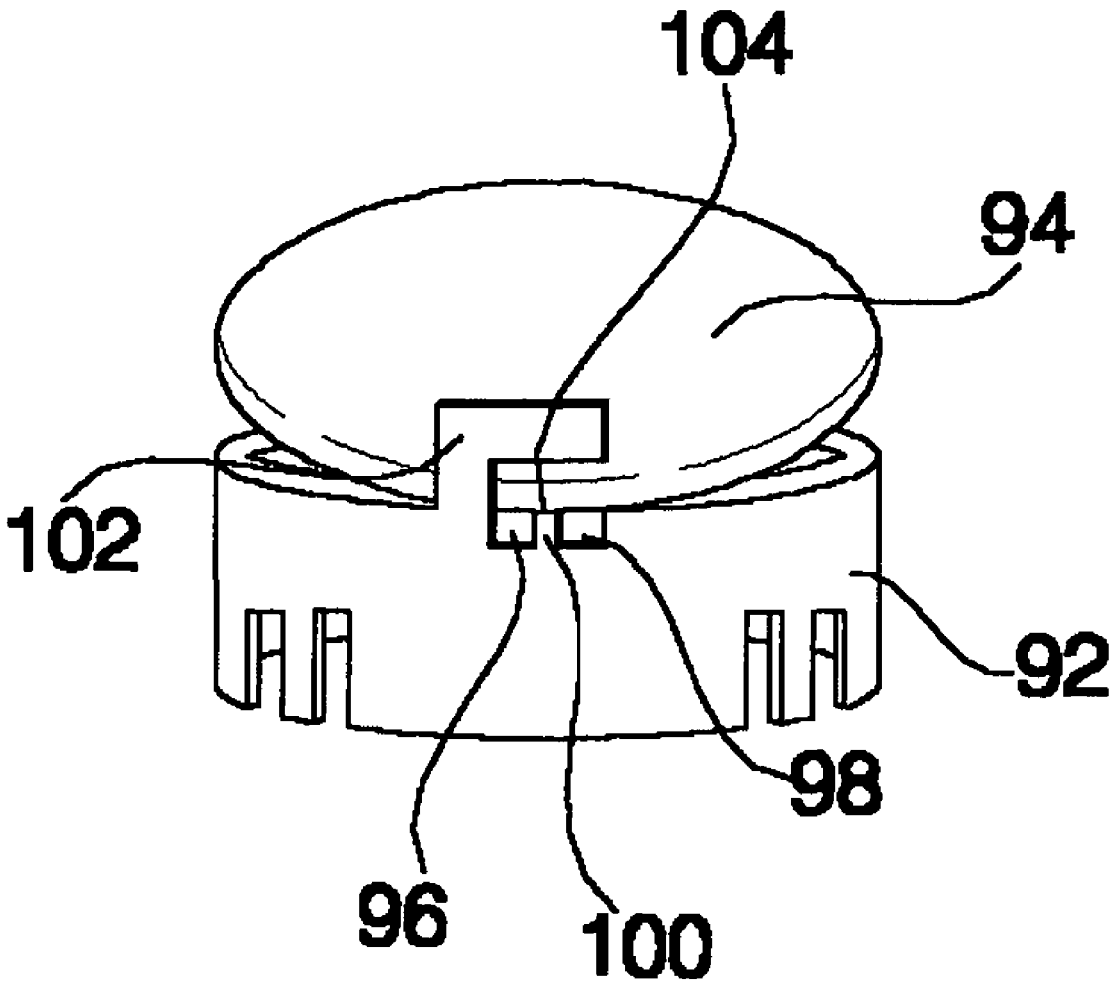
FIG. 4 is a perspective view of a door of the structure in accordance with the first embodiment of the present invention.

FIG. 1 is a perspective view of a washing machine of the present invention. FIG. 2 is an exploded perspective view of a structure for blocking outflow of a fluid for a washing machine in accordance with a first embodiment of the present invention. FIG. 3 is a longitudinal sectional view of the structure in accordance with the first embodiment of the present invention. FIG. 4 is a perspective view of a door of the structure in accordance with the first embodiment of the present invention.

As shown in FIGS. 1 to 4, the structure for blocking outflow of the fluid for the washing machine in accordance with the first embodiment of the present invention comprises a water supply bellows 80 connected to an outlet 76 of a detergent supply unit 70 and a water supply hole (not shown) of a washing tub (not shown), and a door 90 installed on the outlet 76 such that the door 90 can be opened and closed.

Here, the detergent supply unit 70 includes a housing 74 installed in an upper part of a casing 60 and provided with the outlet 76 formed at one side thereof, and a detergent container 72 installed in the housing 74 such that the detergent container 72 is slidable.

One end of the water supply bellows 80 is connected to the outlet 76 of the housing 74, and the other end of the water supply bellows 80 is connected to the water supply hole (not shown) of the washing tub (not shown).

The door 90 is installed at the inside of the outlet 76 of the housing 74, and blocks the flow of a fluid, such as foam or steam generated from the washing tub, towards the detergent supply unit 70 through the water supply bellows 80.

Here, the door 90 includes a stationary member 92 connected to the inside of the outlet 76 and provided with a hole communicating with the outlet 76, and a shielding member 94 rotatably connected to one side of the stationary member 92 for shielding the hole of the stationary member 92.

The stationary member 92 has a ring shape, and is hooked into the outlet 76. The shielding member 94 is installed at one side of the stationary member close to the water supply bellows 80, and is opened towards the water supply bellows 80.

A groove 96 is formed in the side surface of the stationary member 92, and a protrusion 98 is formed on one side of the shielding member 94 at a position corresponding to the groove 96. The protrusion 98 is fitted into the groove 96 by pressure.

An insertion protrusion 100 protruded towards the shielding member 94 is formed on the central portion of the groove 96 of the stationary member 92, and an insertion groove 104 is formed in the protrusion 98 of the shielding member 94. The insertion protrusion 100 is inserted into the insertion groove 104, thereby connecting the shielding member 94 to the stationary member 92.

A stopper 102 having an L-shape is protruded from the stationary member 92 so that the shielding member 94 is not separated from the stationary member 92 and is latched on the stationary member 92 when the shielding member 94 is rotated by the movement of wash water, and is opened from the stationary member 92.

Preferably, the shielding member 94 is made of rubber having high elasticity so that the shielding member 94 is opened by the movement of the wash water flowing from the detergent supply unit 70 to the water supply bellows 80.

Hereinafter, operation of the above structure for the washing machine in accordance with the first embodiment of the present invention will be described.

First, laundry is put into a drum 64, and detergent is poured into the detergent container 72 drawn from the housing 74 of the detergent supply unit 70. Then, the detergent container 72 is pushed into the housing 74.

Thereafter, when wash water is supplied, the wash water is mixed with the detergent in the detergent supply unit 70, and is then supplied to the water supply hole (not shown) of the washing tub through the water supply bellows 80.

Here, the wash water flowing from the outlet 76 of the housing 74 to the water supply bellows 80 pushes the shielding member 94 of the door 90 installed at the outlet 76, thereby opening the door 90.

When the door 90 is opened, the detergent and the wash water are supplied to the washing tub through the water supply bellows 80, and, after the supply of the wash water is completed, the shielding member 94 of the door 90 is returned to its original position via its own inertia. Thereby, the outlet 76 is closed.

Thereafter, when the drum 64 is rotated, foam is generated from the washing tub. The foam reaches the water supply hole (not shown) of the washing tub, and is discharged from the washing tub to the outside through the water supply bellows 80.

However, the shielding member 94 of the door 90 installed at the outlet 76 is closed, and, when the foam pushes the shielding member 94, the shielding member 94 is latched on the stationary member 92 of the door 90 and is not opened towards the detergent supply unit 70.

Accordingly, the foam does not pass through the outlet 76 of the detergent supply unit 70, and is not discharged to the detergent supply unit 70.

In the case that steam generated from the washing tub is discharged to the water supply bellows 80 in the boiling or drying operation, the shielding member 94 of the door 90 installed at the outlet 76 of the housing 74 blocks a flow channel, thereby preventing the steam from being discharged to the detergent supply unit 70.

Figure 5:
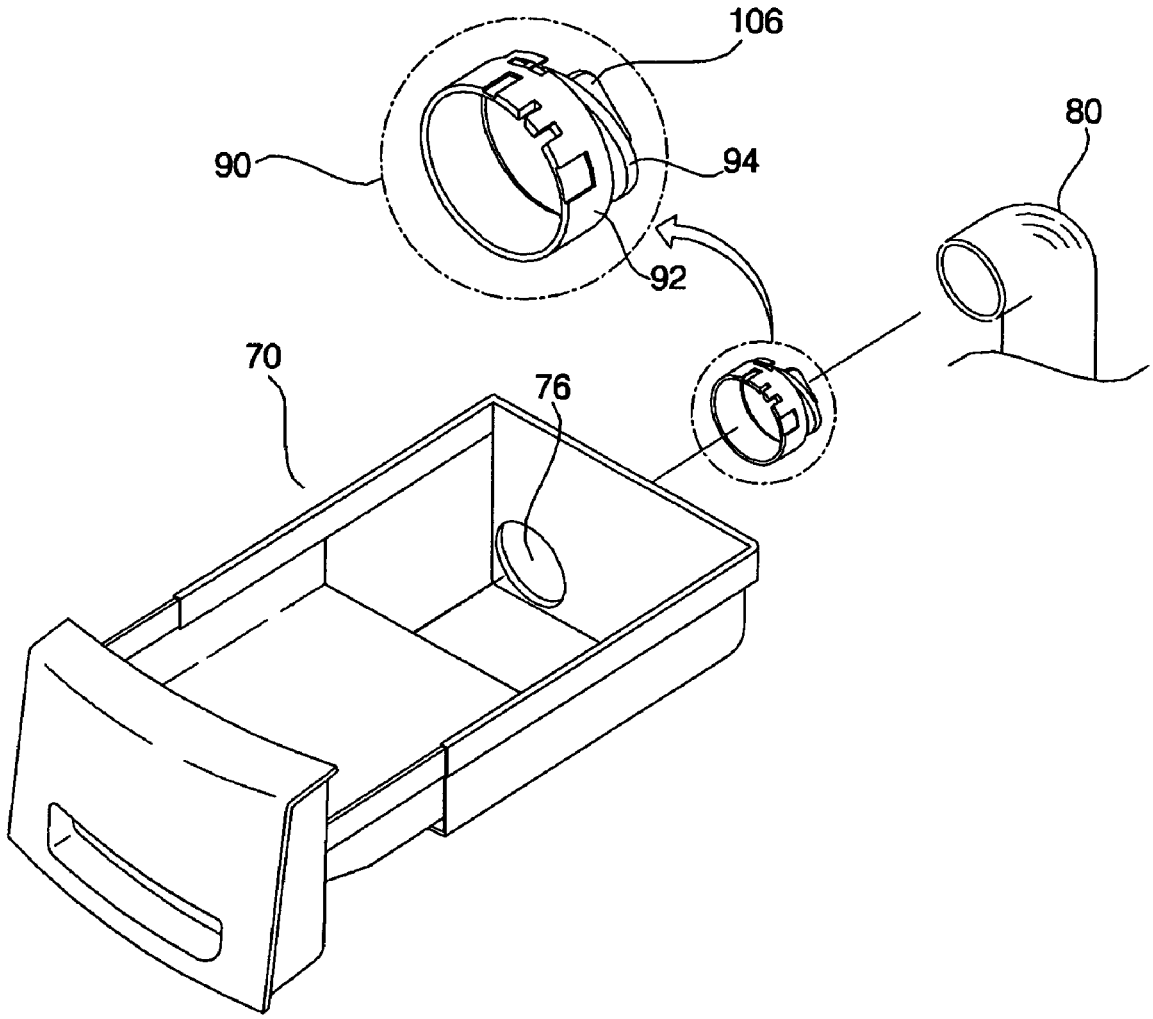
FIG. 5 is an exploded perspective view of a structure for blocking outflow of a fluid for a washing machine in accordance with a second embodiment of the present invention.
Figure 6:
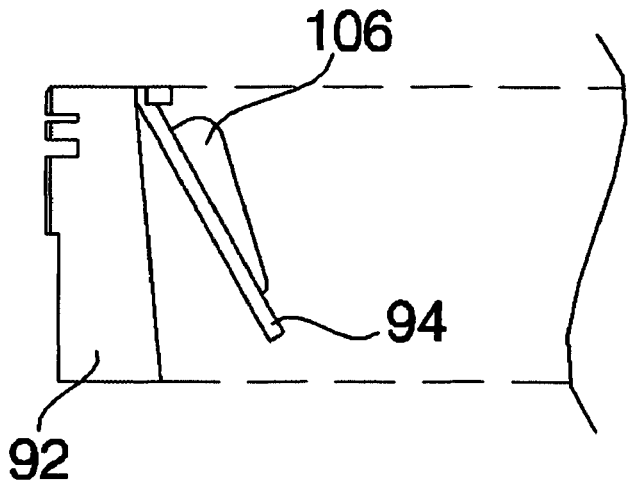
FIG. 6 is a longitudinal sectional view of a door provided with an insert-preventing unit of the structure in accordance with the second embodiment of the present invention.
Figure 7:
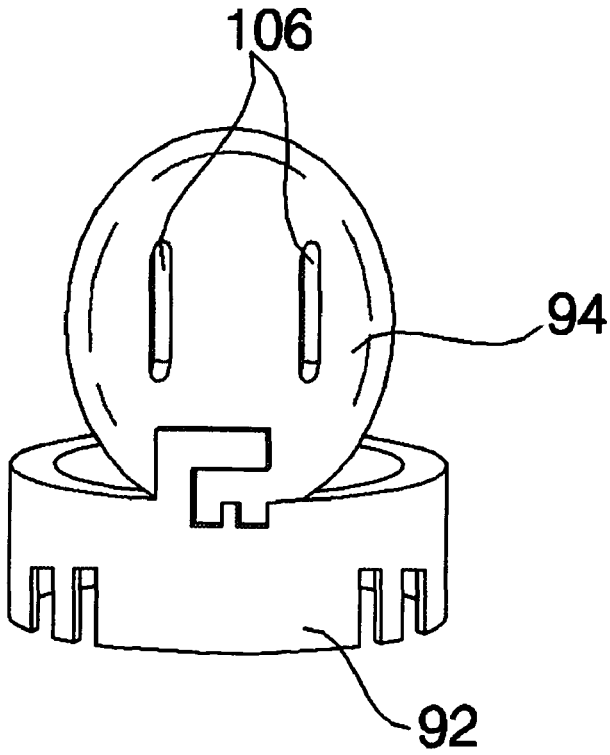
FIG. 7 is a perspective view of the door provided with the insert-preventing unit of the structure in accordance with the second embodiment of the present invention.

FIG. 5 is an exploded perspective view of a structure for blocking outflow of a fluid for a washing machine in accordance with a second embodiment of the present invention. FIG. 6 is a longitudinal sectional view of a door provided with insert-preventing unit of the structure in accordance with the second embodiment of the present invention. FIG. 7 is a perspective view of the door provided with the insert-preventing unit of the structure in accordance with the second embodiment of the present invention.

As shown in FIGS. 5 to 7, the configuration of the structure for blocking outflow of the fluid for the washing machine in accordance with the second embodiment is the same as that of the structure in accordance with the first embodiment except that an insert-preventing unit for preventing the shielding member 94 from being inserted into the water supply bellows 80 when the door 90 is opened is installed on the door 90 installed at the detergent supply unit 70. Elements of the structure of the second embodiment, which are substantially the same as those of the structure of the first embodiment, are denoted by the same reference numerals even though they are depicted in different drawings, and a detailed description thereof will thus be omitted because it is considered to be unnecessary.

The insert-preventing unit includes a plurality of ribs 106 protruded from the shielding member 94 towards the water supply bellows 80 so that the ribs 106 first contact the water supply bellows 80 and are latched on the water supply bellows 80 when the shielding member 94 is rotated.

The ribs 106 are protruded from the shielding member 94 in a longitudinal direction, and are designed such that the heights of the ribs 106 are gradually increased close to a connected portion of the shielding member 94 and the stationary member 92.

Here, the ribs 106, which are disposed in parallel, are prepared in one pair at the side surface of the shielding member 94 towards the water supply bellows 80.

The shielding member 94 has an oval shape such that a diameter of the shielding member 94 in a transverse direction is a short axis, thereby not interfering with the water supply bellows 80 when the shielding member 94 is opened from and closed to the stationary member 92. The length of the short axis of the shielding member 94 is shorter than the diameter of the water supply bellows 80.

Hereinafter, operation of the above structure for the washing machine in accordance with the second embodiment of the present invention will be described. First, wash water, which is mixed with detergent, flows from the outlet 76 of the detergent supply unit 70 to the water supply bellows 80, and pushes the shielding member 94 of the door 90 installed at the outlet 76.

Here, when the shielding member 94 of the door 90 is rotated to a designated angle, the ribs 106 contact the upper part of the inner surface of the water supply bellows 80.

When the ribs 106 contact the water supply bellows 80, the shielding member 94 is not rotated any more, and does not directly contact the water supply bellows 80, thereby not being inserted into the water supply bellows 80.

Figure 8:
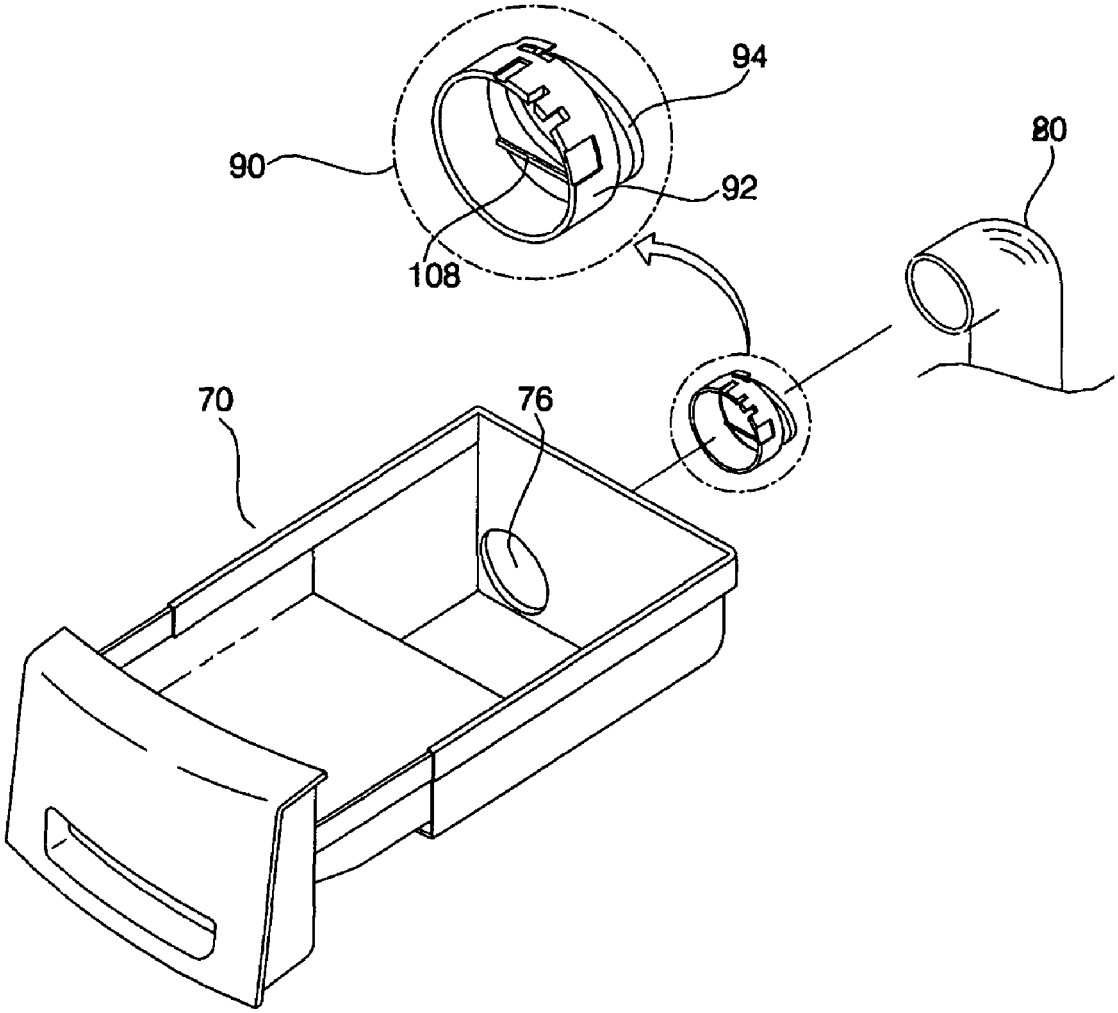
FIG. 8 is an exploded perspective view of a structure for blocking outflow of a fluid for a washing machine in accordance with a third embodiment of the present invention.

FIG. 8 is an exploded perspective view of a structure for blocking outflow of a fluid for a washing machine in accordance with a third embodiment of the present invention.

As shown in FIG. 8, the configuration of the structure for blocking outflow of the fluid for the washing machine in accordance with the third embodiment is the same as that of the structure in accordance with the first embodiment except that a push-preventing unit for preventing the shielding member 94 from being pushed towards the detergent supply unit 70 is installed on the door 90 installed at the detergent supply unit 70. Elements of the structure of the third embodiment, which are substantially the same as those of the structure of the first embodiment, are denoted by the same reference numerals even though they are depicted in different drawings, and a detailed description thereof will thus be omitted because it is considered to be unnecessary.

The push-preventing unit includes a rod 108, both ends of which are connected to both side surfaces of the stationary member 92 such that the rod 108 crosses the hole of the stationary member 92.

The rod 108 is horizontally disposed below the center of the hole, thereby preventing the lower part of the shielding member 94 from passing through the hole of the stationary member 92 and being pushed into the outlet 76.

That is, when the shielding member 94 is pushed towards the outlet 76 by the pressure of air in the water supply bellows 80, the shielding member 94 is latched on the rod 108 installed on the stationary member 92, thereby preventing the shielding member 94 from being pushed into the outlet 76.

Figure 9:
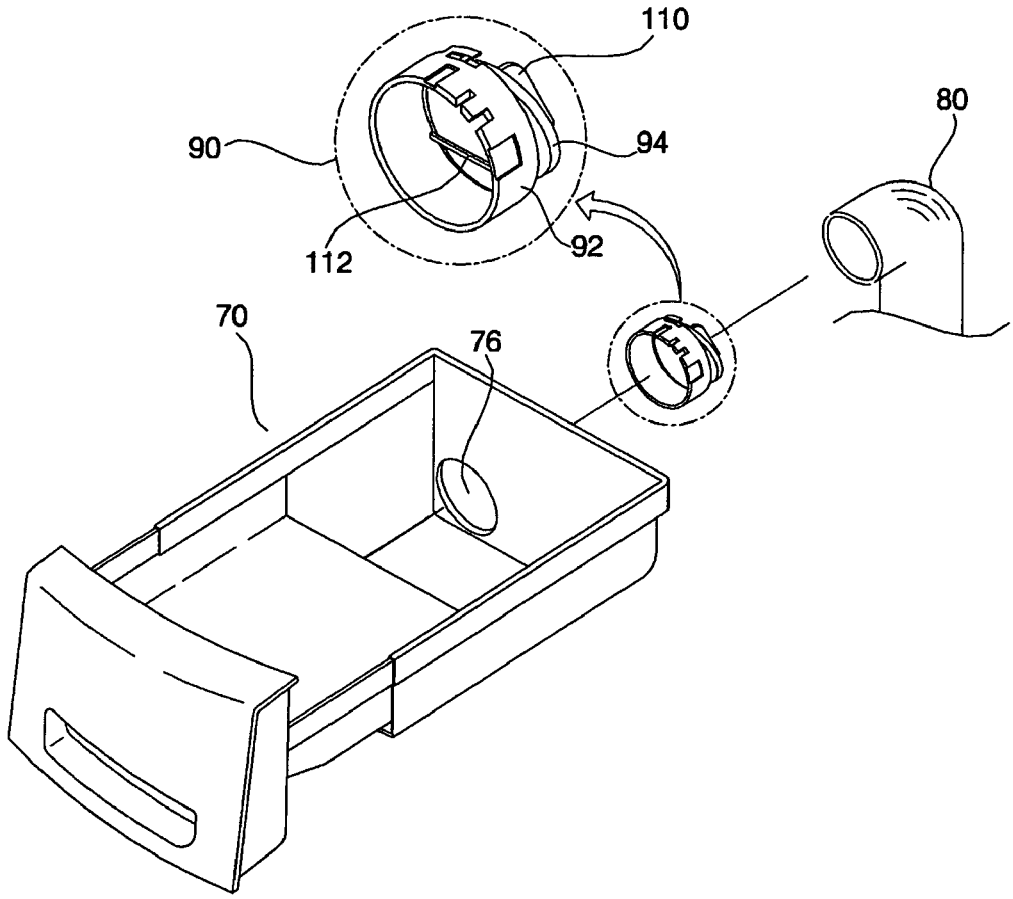
FIG. 9 is an exploded perspective view of a structure for blocking outflow of a fluid for a washing machine in accordance with a fourth embodiment of the present invention.

FIG. 9 is an exploded perspective view of a structure for blocking outflow of a fluid for a washing machine in accordance with a fourth embodiment of the present invention.

As shown in FIG. 9, the configuration of the structure for blocking outflow of the fluid for the washing machine in accordance with the fourth embodiment is the same as that of the structure in accordance with the first embodiment except that an insert-preventing unit for preventing the shielding member 94 from being inserted into the water supply bellows 80 when the door 90 is opened and a push-preventing unit for preventing the shielding member 94 from being pushed towards the detergent supply unit 70 are installed on the door 90 installed at the detergent supply unit 70. Elements of the structure of the fourth embodiment, which are substantially the same as those of the structure of the first embodiment, are denoted by the same reference numerals even though they are depicted in different drawings, and a detailed description thereof will thus be omitted because it is considered to be unnecessary.

The insert-preventing unit includes a plurality of ribs 110 protruded from the shielding member 94 towards the water supply bellows 80 so that the ribs 110 first contact the water supply bellows 80 and are latched on the water supply bellows 80 when the shielding member 94 is rotated.

The push-preventing unit includes a rod 112, both ends of which are connected to both side surfaces of the stationary member 92 such that the rod 112 crosses the hole of the stationary member 92.

Hereinafter, effects of a structure for blocking outflow of a fluid for a washing machine in accordance with the present invention will be described.

Since a door installed at an outlet of a detergent supply unit opens the outlet when wash water and detergent are supplied from the detergent supply unit to a washing tub, and closes the outlet of the detergent supply unit when foam or steam are discharged from the washing tub to the detergent supply unit, the structure of the present invention prevents the fluid, such as the foam or steam in the washing tub, from flowing to the detergent supply unit.

The structure of the present invention prevents the detergent supply unit from being contaminated by the foam or steam discharged from the washing tub, and neighboring elements from being corroded.

Since a shielding member of the door installed at the outlet of the detergent supply unit has an oval shape, the shielding member does not interfere with a water supply bellows when the shielding member is rotated.

Since a plurality of ribs are protruded from the shielding member, the ribs first contact the water supply bellows when the shielding member is rotated, thereby preventing the shielding member from being inserted into the water supply bellows.

Since a rod, serving as a push-preventing unit, is installed on a stationary member of the door installed at the outlet of the detergent supply unit such that the rod crosses a hole of the stationary member, the rod latches the shielding member when the shielding member of the door is closed after the supply of the wash water is completed, thereby preventing the shielding member from being pushed towards the detergent supply unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A structure for blocking outflow of a fluid for a washing machine comprising:

a housing of a detergent supply unit provided with an outlet from which detergent and washing water are discharged;

a water supply bellows provided with one end connected to the outlet of the housing and another end connected to a water supply hole of a washing tub; and a door installed at the outlet of the housing opened by wash water flowing from the outlet of the housing towards the washing tub and closed by fluid flowing upstream from the washing tub towards the detergent supply unit, wherein the door comprises:

a stationary member inserted into the outlet and provided with a hole communicating with the outlet, a shielding member rotatably connected to one side of the stationary member at a hinge point for opening and closing the hole of the stationary member, the shielding member being opened by wash water flowing from the outlet of the housing towards the washing tub and closed by fluid flowing upstream from the washing tub towards the detergent supply unit; and wherein an L-shaped stopper for preventing the shielding member from being separated from the stationary member protrudes from the stationary member, the L-shaped member having a first leg extending outwardly from the stationary member at a point next to the hinge point and a second leg extending from the first leg towards the hinge point.

2. The structure as set forth in claim 1, wherein an insertion protrusion is protruded from a groove in the stationary member towards the shielding member, and an insertion groove, into which the insertion protrusion is inserted, is formed in a protrusion of the shielding member.

3. The structure as set forth in claim 1, further comprising an insert-preventing unit for preventing the shielding member from being in contact with the water supply bellows when the door is opened.

4. The structure as set forth in claim 1, wherein a groove is formed in the side surface of the stationary member, and a protrusion, which is fitted into the groove by pressure, is formed on one side of the shielding member to hingedly connect the shielding member to the stationary member.

5. The structure as set forth in claim 1, further comprising a detergent container slidably received in the housing.

* * * * *